United States Patent [19]

Fuhrmeister

[11] 4,019,238

[45] Apr. 26, 1977

[54] APPARATUS FOR RIVETING

[75] Inventor: Ralph Fuhrmeister, Queensland, Australia

[73] Assignee: Furma Manufacturing Co. Pty. Ltd., Queensland, Australia

[22] Filed: Oct. 8, 1975

[21] Appl. No.: 620,764

[52] U.S. Cl. ..... 29/243.53

[51] Int. Cl.[2] ..... B23P 11/00

[58] Field of Search ..... 29/243.53, 243.54, 243.55

[56] References Cited

UNITED STATES PATENTS

| | | | |
|---|---|---|---|
| 3,574,918 | 4/1971 | Focht | 29/243.54 |
| 3,874,070 | 4/1975 | Falcioni | 29/243.53 |

*Primary Examiner*—James L. Jones, Jr.
*Attorney, Agent, or Firm*—Donald D. Jeffery

[57] ABSTRACT

Sheet material pieces are riveted together by punching a hole in the pieces with a rivet driven through them and into an oversize female die, which is then moved to move the penetrated pieces towards the head of the rivet. The rivet is further advanced so that the end which has penetrated the pieces is flattened and radially enlarged against an anvil. This radially enlarged end may be withdrawn from the oversize female die.

2 Claims, 5 Drawing Figures

APPARATUS FOR RIVETING

BACKGROUND OF THE INVENTION

The invention relates to a method of and apparatus for riveting, and it has more particular reference to the riveting together of sections of sheet metal or other sheet materials.

The riveting together of two sheet metal parts normally involves three steps: the formation of corresponding or registering holes through the two parts, the insertion of a rivet through the two parts, the insertion of rivet through the two aligned holes, and the deformation, to expand the diameter, of the inserted end portion of the rivet.

Riveting therefore may be a fairly time consuming operation. Another aspect of riveting which in certain aplications is disadvantageous is that the rivet head normally projects above the surrounding riveted material. In some cases it is desirable that the surface should be flush, withour projections therefrom.

SUMMARY OF THE INVENTION

The present invention has been devised with the general object of providing a riveting method and apparatus for very materially reducing the time, labour and cost involved in many riveting operations. Another object of the invention is to provide such a method and apparatus for effecting particularly strong riveted joints in which the rivet heads may be countersunk and so not break the flush surfaces of the material through which they are driven.

With the foregoing and other objects in view, the invention resides broadly, in one aspect, in a method of riveting members of sheet material including the steps of punching a hole through the adjacently located sheet material members by driving a rivet through said members and into an oversize female die, radially enlarging the penetrating end of the rivet shank to prevent withdrawal of the rivet from said members, the female die being such as to permit the withdrawal of the radially enlarged rivet shank end therefrom.

In another aspect, the invention resides broadly in apparatus for riveting sheet material members including a frame; a female die on the frame; a rivet carrier on the frame for supporting a rivet; a rivet driver for advancing the rivet, shank first, to the said die, to penetrate adjacent sheet material members interposed between the said die and the rivet carrier and to enter the die; and means for radially enlarging or otherwise deforming the penetrating end of the rivet shank, the said die being such as to permit the withdrawal of the deformed end of the rivet shank therefrom. Preferably the means for deforming the end of the rivet shank includes an anvil, the die and anvil being mounted on the frame for relative movement such that, when rivet shank penetrates the sheet material members, the anvil is caused to enter the die in the direction opposite that of the movement of the rivet shank, which is flattened against the anvil, the die being of greater diameter than the flattened rivet end, which therefore can be readily withdrawn from the die. Other features of the invention will become apparent from the following description.

BRIEF DESCRIPTION OF THE DRAWINGS

A preferred embodiment of the invention is illustrated in the accompanying drawings, wherein.

DETAILED DESCRIPTION OF THE PREFERRED EMBODIMENT OF THE INVENTION

Figure 1:
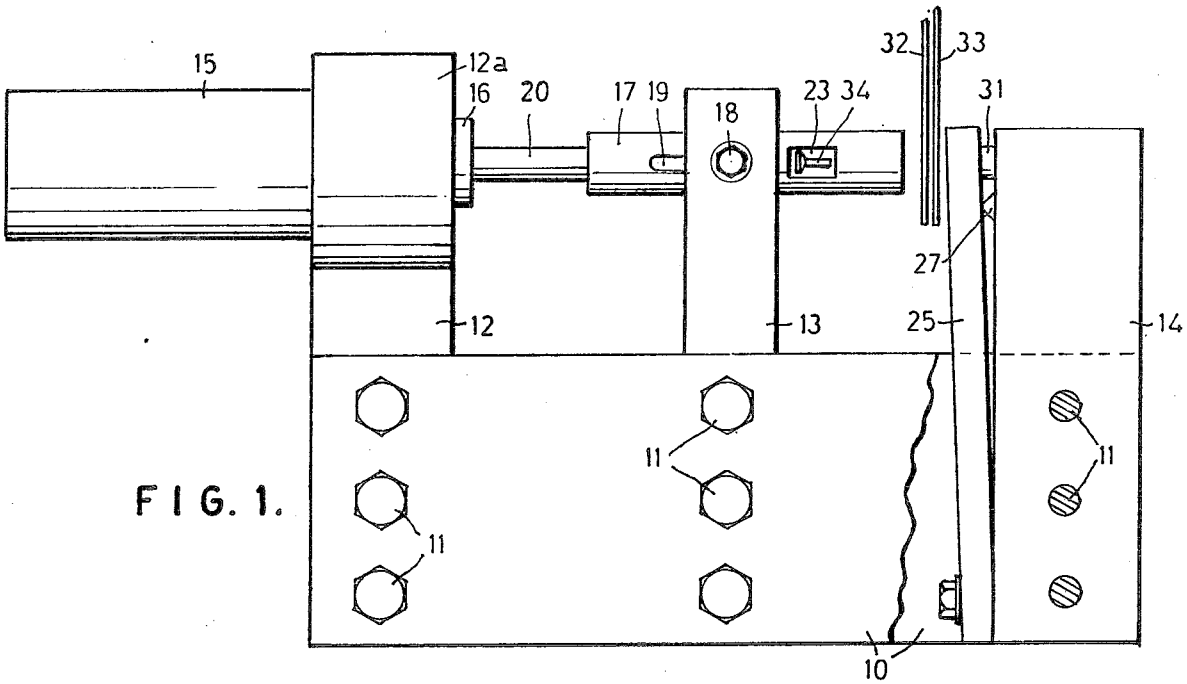
FIG. 1 is a partly broken-away plan view of riveting apparatus according to the invention.

The apparatus shown in the drawings includes a pair of similar parallel plates 10 rigidly secured by bolts 11 to opposite sides of a cylinder holder 12, a rivet carrier bearing member 13 and an anvil holder 14, all of which extend in parallel arrangement beyond the said plates.

The cylinder holder 12 has a substantially cylindrical part 12*a* through which is formed a tapped axial hole into which a threaded end of a hydraulic cylinder 15 is screwed. This cylinder 15 may serve as a handle for the apparatus. The hydraulic cylinder is of double-acting type, its plunger 16 being advanced or retracted by hydraulic fluid conducted through conventional hydraulic hoses which, for clarity, are omitted from the drawings.

The rivet carrier bearing member 13 is formed with a bearing, coaxial with the cylinder 15 and its plunger 16, in which a cylindrical rivet carrier 17 is slidable, a pair of stop bolts 18 engaged in tapped holes in opposite sides of the member 13 engaging in diametrically opposite longitudinal grooves 19 in the rivet carrier 17, the slidable movement of which in either direction is thus limited.

An axial hole is formed from the end of the hydraulic cylinder plunger 17 to receive an end of a cylindrical rivet driver 20, which is secured by a diametral pin 21. The driver 20 is slidable through an axial hole 22 formed through the rivet carrier 17. A rivet feeding opening 23 leads radially through the rivet carrier 17 into the said axial hole 22. Near to the end of the rivet carrier remote from the cylinder 15, an annular groove is formed within the axial hole 22 to receive the peripheral part of a coned and centrally apertured rivet guide 24, which is moulded of a tough resiliently deformable plastic material, the axial hole 22 between this groove and the said end of the rivet carrier being of greater diameter than the driver 20, but lesser diameter than the said groove.

Figure 3:
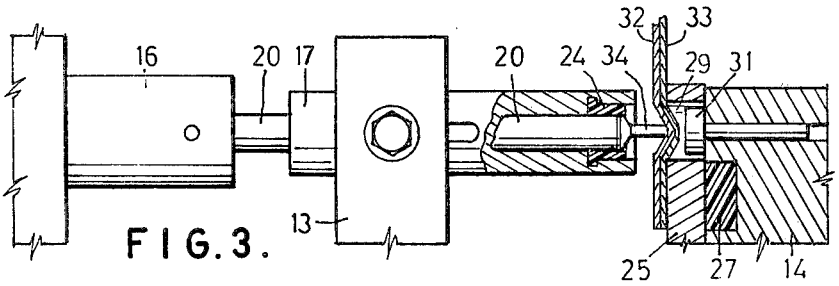
Figure 5:
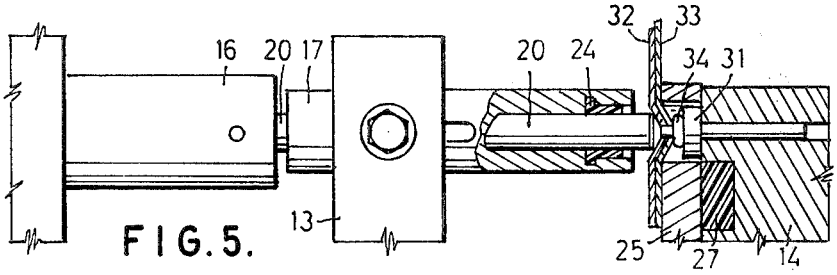

Between the plates 10, one end of a stripper plate 25 is secured, with limited pivotal movement, to the corresponding end of the anvil holder 14 by means of a bolt 26 so that, as shown in FIG. 1, it may be inclined at a small angle to the anvil holder 14, in the direction of the rivet holder 17, or moved back against the anvil holder. The stripper plate 25 is urged to its inclined position by a coned resilient member 27 seated in a cylindrical hole 28 in the anvil holder 14, the apex of the resilient cone 27 bearing against the stripper plate 25. However, if sufficient pressure is applied to the stripper plate, it may be moved against the anvil holder 14 deforming the resilient cone 27 and forcing it into the hole 28, as shown in FIGS. 3 and 5. Through the stripper plate 25 there is formed a hole 29 which, when the stripper plate is against the die holder 14, is coaxial with the striker 20. The hole 29 with the surrounding part of the stripper plate constitutes a female die.

A hole 30 through the anvil holder 14 accepts the stem of an anvil 31, which is cylindrical and coaxial with the rivet driver 20 and which enters, with some clearance, the female die hole 29 through the stripper plate 25.

In riveting together two sheet metal sections 32 and 33, these sections are positioned as shown in FIG. 1, close to the stripper plate 25, which is in its oblique position, the hydraulic cylinder plunger 16, the driver 20 and the rivet carrier 17 being initially retracted to full extend. A rivet 34 is fed by way of the rivet feed opening 23 into the axial hole 22 through the rivet carrier, ahead of the fully retracted driver 20.

Figure 2:
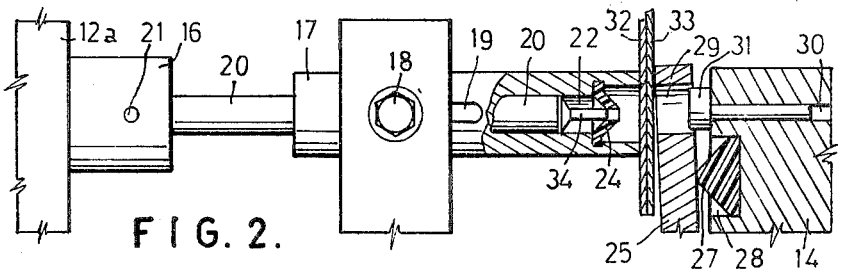
FIGS. 2, 3, 4 and 5 are partly broken-away views, to larger scale, of parts of the machine during successive stages in the riveting together of two sheet metal work pieces.

The hydraulic cylinder 15 is then operated to cause the plunger 16 to be extended, so that the driver 20 drives the rivet 34 forward to the rivet guide 24, and the rivet carrier 17 is advanced to full extent, against the sheet metal pieces 32 and 33, which are brought against the female die of the stripper plate 25, as shown in FIG. 2.

As the rivet driver 20 continues to advance, as shown in FIG. 3, the rivet 34 is pushed through the resiliently deformable rivet guide 24 which frictionally holds the rivet head so the rivet remains coaxial with the driver, the leading end of the driver 20 following the rivet through the rivet guide which is deformed to more or less cylindrical shape. The rivet 34 striking against the sheet metal pieces forces the stripper plate 25 and its female die against the anvil holder 14, deforming the resilient come 27, and pressing the sheet metal to some extent into the oversize female die.

Figure 4:
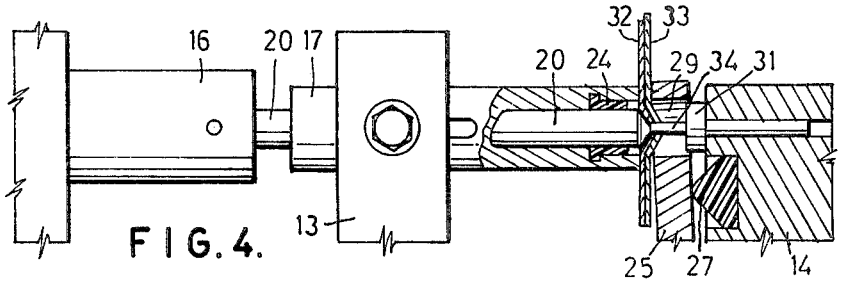

As shown in FIG. 4, further advance of the driver 20 causes the rivet 34 to be driven through the sheet metal pieces 32 and 33, into the female die 29 and against the anvil 31. The stripper plate 25 is free, once the rivet has penetrated the sheet metal, to return to inclined position under the action of the resilient cone 27.

As shown in FIG. 5, the final advancing movement of the driver 20 causes the shank of the rivet 34, which has penetrated the sheet metal pieces 32 and 33, to be spread against the anvil to complete the riveting.

The hydraulic cylinder plunger 16 is then retracted. Owing to the friction between the rivet guide 24 and the driver 20, the rivet carrier 17 is retracted to its full extent and after it has been restrained against further movement, the retraction of the driver 20 continues until the parts of the apparatus are returned to initial position as shown in FIG. 1. The deformed leading end of the rivet can, of course, be easily withdrawn from the oversize female die 29, so the riveted metal pieces may be moved clear of the apparatus.

It will be noted that the head of the rivet 34 is countersunk in the dished formation of the sheet metal pieces, resulting from the deformation of the sheet metal into the oversize female die. The flush surface of the outermost sheet metal piece, then, is unbroken by a protruding rivet head, which is advantageous in certain applications. Since the rivet has been driven through the sheet metal pieces, its shank is very firmly held frictionally, and the riveted joint is particularly strong for this reason, and also because of the dished formation of the metal pieces about the rivet. Stresses applied to the joint will be resisted by one coned surface bearing hard on another.

What I claim is:

1. Apparatus for riveting sheet material members including:

a frame, a female die mounted on the frame, an anvil mounted on the frame, a rivet carrier having a passage therethrough, means for conveying a rivet into said passage, a rivet driver slidable through the passage of the rivet carrier and adaptable to advance the rivet shank-first, relative to the female die, and a resilient rivet guide within the passage adapted to engage frictionally a rivet advanced by the rivet driver through the passage for maintaining the rivet parallel to its direction of advance, said rivet driver being adapted to drive the rivet into the female die and towards the anvil thereby penetrating adjacent sheet material members interposed between the rivet carrier and the die, said anvil being adapted to enlarge radially the penetrating end of the rivet shank, and said female die being adapted to permit the withdrawal therefrom of the radially enlarged end of the rivet shank.

2. Apparatus according to claim 1 wherein:

said anvil is mounted fixedly on the frame, said female die is mounted on the frame for movement towards the anvil or towards the rivet carrier, and resilient means are provided for biasing the female die in the direction towards the rivet carrier.

* * * * *